United States Patent [19]

Mori et al.

[11] Patent Number: 4,834,566

[45] Date of Patent: May 30, 1989

[54] TYPEWRITER HAVING MEANS FOR INTERRUPTION OF AUTOMATIC ERASING OPERATION, AND/OR AUTOMATIC SUSPENSION THEREOF AT EACH SPACE BETWEEN SUCCESSIVE WORDS

[75] Inventors: Masaharu Mori, Anjo; Hideo Ueno, Nagoya; Kiyoshi Yamakawa, Gifu; Yuji Kawakami; Ryoichi Sasaki, both of Nagoya, all of Japan

[73] Assignee: Brother Kogyo Kabushiki Kaisha, Aichi, Japan

[21] Appl. No.: 947,365

[22] Filed: Dec. 29, 1986

[30] Foreign Application Priority Data

Dec. 29, 1985 [JP] Japan ..... 60-298530
Dec. 29, 1985 [JP] Japan ..... 60-298531
Mar. 11, 1986 [JP] Japan ..... 61-53089

[51] Int. Cl.[4] ..... B41J 29/36
[52] U.S. Cl. ..... 400/697; 400/695
[58] Field of Search ..... 400/696, 697.1, 695, 400/697, 700

[56] References Cited

U.S. PATENT DOCUMENTS 3,870,846 3/1975 Filip ..... 200/161
3,997,046 12/1976 Wolowitz ..... 400/696 X
4,202,637 5/1980 Tummolo ..... 400/696 X
4,245,918 1/1981 Bowles et al. ..... 400/697.1
4,374,626 2/1983 Hooker ..... 400/696 X
4,413,266 1/1983 Aviram et al. ..... 400/696 X
4,561,793 12/1985 Blanchard, Jr. ..... 400/697.1 X

FOREIGN PATENT DOCUMENTS 60-210482 10/1985 Japan ..... 400/697

*Primary Examiner*—Paul T. Sewell
*Assistant Examiner*—James R. McDaniel
*Attorney, Agent, or Firm*—Parkhurst, Oliff & Berridge

[57] ABSTRACT

A typewriter having an automatic erasing function, having an erasing device responsive to an erasure-start key, for effecting an erasing operation to successively erase the characters printed by a printing device, and a controller responsive to the erasure-stop key, for permitting the erasing device to interrupt the erasing operation. The typewriter has an input buffer for storing input data which is entered through a keyboard while the erasing device is operated, the typewriter. The typewriter may be arranged so that the input buffer is cleared upon operation of an erasure-stop key. The above arrangement may be adapted to erase successive words on a display device as character and space data are retrieved from a memory. In this case, a device may be provided to suspend a continuous erasing operation for a predetermined time each time the space data representative of a space between the words has been retrieved from the memory after at least one character has been erased.

12 Claims, 11 Drawing Sheets

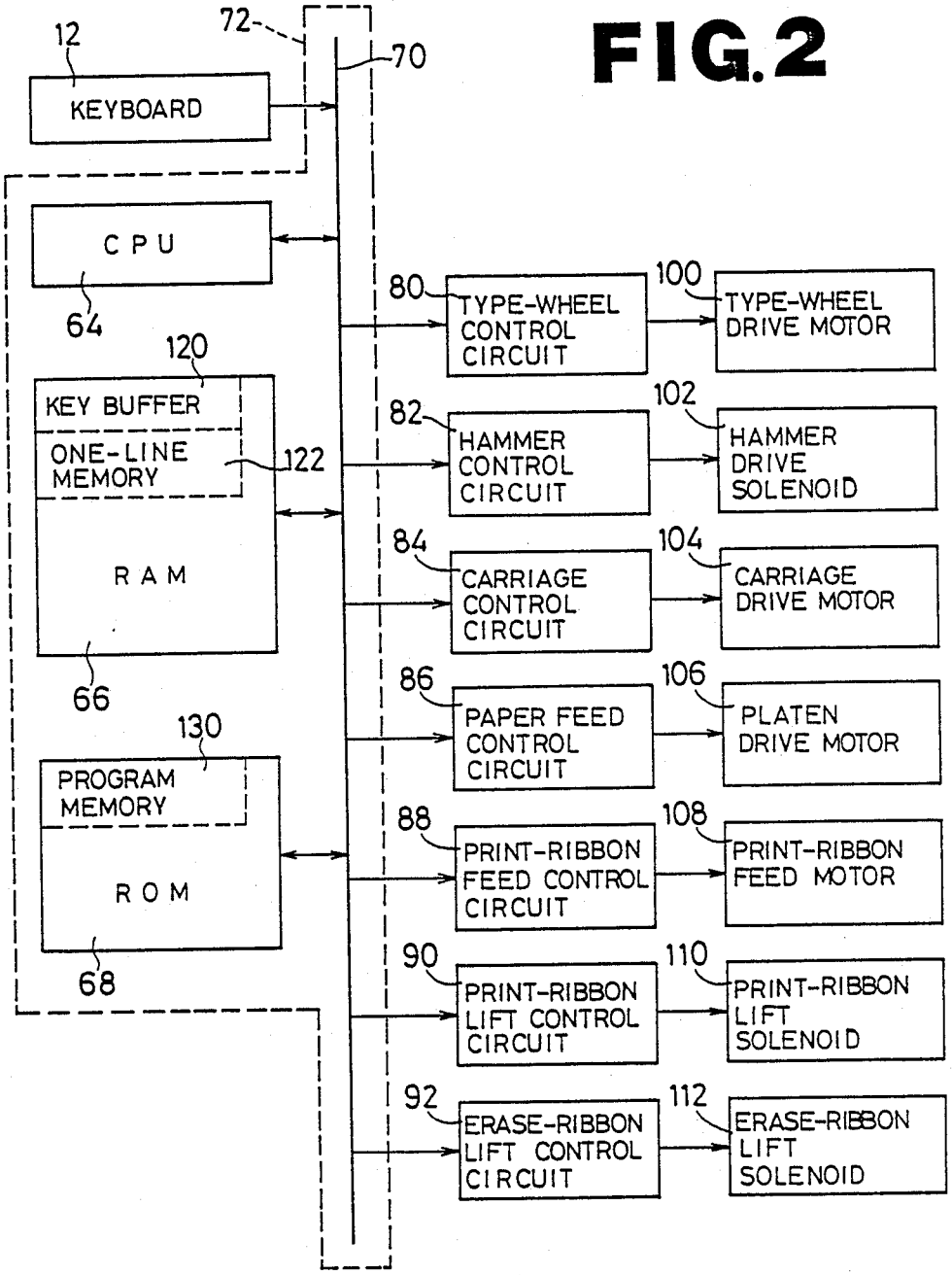
FIG. 2
12
KEYBOARD
72
70
CPU
64
120
KEY BUFFER
ONE-LINE MEMORY
122
RAM
66
130
PROGRAM MEMORY
ROM
68
80
TYPE-WHEEL CONTROL CIRCUIT
100
TYPE-WHEEL DRIVE MOTOR
82
HAMMER CONTROL CIRCUIT
102
HAMMER DRIVE SOLENOID
84
CARRIAGE CONTROL CIRCUIT
104
CARRIAGE DRIVE MOTOR
86
PAPER FEED CONTROL CIRCUIT
106
PLATEN DRIVE MOTOR
88
PRINT-RIBBON FEED CONTROL CIRCUIT
108
PRINT-RIBBON FEED MOTOR
90
PRINT-RIBBON LIFT CONTROL CIRCUIT
110
PRINT-RIBBON LIFT SOLENOID
92
ERASE-RIBBON LIFT CONTROL CIRCUIT
112
ERASE-RIBBON LIFT SOLENOID

TYPEWRITER HAVING MEANS FOR INTERRUPTION OF AUTOMATIC ERASING OPERATION, AND/OR AUTOMATIC SUSPENSION THEREOF AT EACH SPACE BETWEEN SUCCESSIVE WORDS

BACKGROUND OF THE INVENTION

1. Field of the Invention

The present invention relates to a typewriter having a function of automatically erasing a group of successive characters having a certain length, that is, a word, a phrase, or a line of characters, and/or an improved typewriter having a function of continuously erasing successive words which are presented on a suitable data-presentation means such as a display or a recording medium, such that the adjacent words are separated from each other by spaces.

2. Discussion of the Prior Art

Laid-Open Publication No. 60-210482 of Japanese Patent Application discloses a typewriter capable of erasing a word or words. In this typewriter, the operator depresses a word-erase key after a carriage of the typewriter has been positioned at one of characters of a word that the operator wishes to erase. In response to the operation of the word-erase key, the carriage is automatically moved to the last character of the word, and an operation to erase the word is initiated. After the first character of the word has been erased, the erasing operation is automatically terminated. When it is desired to erase a plurality of words, the carriage is moved to the last one of the words, and the word-erase key is operated a plurality of times corresponding to the number of the words to be erased. The typewriter repeats a word erasing cycle in response to the repetitive operations of the word erase key, and the erasing operation is automatically terminated. Also known is a typewriter which has a function of erasing a line of characters by a single depression of a suitable key.

In such a known typewriter capable of automatically erasing a desired length of characters, such as a single word, or a phrase or a line consisting of a plurality of words, a typing job may be achieved efficiently.

In the known typewriter discussed above, however, an erasing operation cannot be stopped or interrupted once the operation has been initiated. The operator often notices an error in designating a portion of a material to be erased, after the erasing operation has been started. In this case, the erasing cycle is automatically repeated until all of the characters of the designated portion of the material have been erased. This is inconvenient, since the operator must wait until the characters which are not actually necessary to erase have been erased, before the typewriter becomes ready for permitting the operator to start keying in the desired data.

For improved typing efficiency, it is desirable to enter data during an automatic erasing operation, so that the thus entered data may be printed after the completion of the erasing operation. If data is erroneously entered during an erasing operation, or if the portion to be erased has been erroneously designated, the data entered during the erasing operation must also be erased after this erroneous data is printed. This extra erasure is time-consuming.

There is also known a typewriter as disclosed in U.S. Pat. No. 3,870,846, wherein an operation to erase a character (letter, numeral or symbol) is automatically repeated while an erase key is held operated. Thus, two or more words may be automatically erased. In this arrangement, therefore, the operator must release the erase key just when the erasure of the last charcter of the last word to be erased is completed.

It is considered possible that once the erase key has been operated, an automatic character erasing operation is repeated until the erase key is again operated. Automatic erasure of a plurality of words is also possible by providing a line-erase key which commands the erasure of a whole line of characters.

While it is preferred to erase the characters at a high speed for improved erasing efficiency, the penalty for this in the above typewriter lies in increased difficulty to manipulate the appropriate key to terminate the erasing operation just when the desired last word to be erased has been erased. In the typewriter equipped with a line-erase key, the operator may sometime notice an erroneous operation of the line-erase key, as soon as the operator has depressed the line-erase key. In this case, a suitable key is preferably operated to cancel or terminate the erasing opeation. However, if the erasing speed is so high, the operation of the key to terminate the operation is delayed, resulting in the erasure of the whole line of characters, which requires re-entry of the erased data.

The above inconveniences may easily be encountered particularly in connection with the erasure of characters being displayed on a display device, since the speed at which the display is cleared is comparatively high. However, the same inconveniences may occur even when the characters printed on a paper are erased, if the erasing speed is relatively high.

SUMMARY OF THE INVENTION

It is a first object of the present invention to provide a typewriter which permits automatic erasure of a desired length of characters, and which allows the operator to interrupt or terminate an erasing operation when the operator notices an error in connection with the erasing operation, after the operation has been started.

A second object of the invention is the provision of a typewriter which has the above function of interrupting an automatic erasing operation, and which permits erasure of data which has been entered during the erasing operation.

A third object of the invention is the provision of a typewriter which permits automatic intermittent erasure of successive words, with a suitable interruption time between the completion of erasure of one word and the commencement of erasure of the next word.

The first object of the invention may be achieved according to the present invention, which provides a typewriter having an automatic erasing function, comprising: a keyboard having a multiplicity of character keys, and function keys including an erasure-start key and an erasure-stop key; memory means for storing input data entered through the keyboard; a printing device operable for printing on a recording medium characters corresponding to the input data entered through the keyboard; an erasing device responsive to the erasure-start key, for effecting an erasing operation to successively erase the characters printed by the printing device; and erasure-stop control means responsive to the erasure-stop key, for permitting the erasing device to interrupt the erasing operation.

In the typewriter of the present invention constructed as described above, the erasing operation initiated by the erasure-start key to erase a desired length of characters forming a word, phrase or a line may be interrupted or terminated by operating the erasure-stop key. Namely, when the operator has noticed an error in designating the row of characters to be erased, the erasing operation may be stopped at any time during the erasure of the characters. This arrangement eliminates otherwise possible unnecessary erasure of characters, and subsequently required re-entry of the unnecessarily erased characters. Thus, the typing efficiency may be improved. Further, in the case where the printed characters are erased with an erase ribbon, a waste of the erase ribbon may be minimized.

According to one feature of the invention, the typewriter further comprises means for checking if a current erasing position of the erasing device is at a predetermined margin position of the recording medium, and also checking if a space exists between the margin position and a last character of a word to be erased next. The typewriter further comprises means for terminating the erasing operation if the space exits between the margin position and the last character of the word to be erased next.

According to another feature of the invention, the typewriter further comprises means for checking if a current erasing position of the erasing device is located at one of the printed characters, or at a space which is preceded by a last character of a word to be erased next in an erasing direction of the erasing device. In this case, the typewriter further comprises means for moving the erasing device one position in the erasing direction before erasing the last character if the current erasing position is at the space, and means for controlling the erasing device to start erasing the above-indicated one printed character without moving the erasing device if the current erasing position is at this one printed character.

According to a further feature of the invention, the typewriter further comprises means for checking if a current erasing position of the erasing device is located at one space which is preceded by at least one other space in an erasing direction of the erasing device, which at least one other space is preceded by a last character of a word to be erased next in the erasing direction. In this instance, the typewriter further comprises means for operating the erasing device to start erasing the word even if the current erasing position of the erasing device is located at the above-indicated one space.

The previously described second object of the invention may be achieved according to a still further feature of the invention, wherein the memory means includes an input buffer for storing the input data which is entered through the keyboard while the erasing device is operated. In this case, the typewriter further comprises buffer-clear control means for clearing the input buffer upon operation of the erasure-stop key.

In the above arrangement, the operation of the erasure-stop key will cause the input buffer to be automatically cleared. Accordingly, the data entered during the erasing operation which is interrupted by the same erasure-stop key is automatically erased from the input buffer. In the situation where the operator committed an error in designating the portion of the material to be erased, and operated the erasure stop key to interrupt an erasing operation, the data that has been entered during the interrupted erasing operation is also erroneous and therefore preferably be deleted from the input buffer. Namely, the instant arrangement eliminates otherwise required erasure of the erroneous data which is otherwise printed after the erasing operation triggered by the erasure-start key has been terminated. Further, if the operator made an error in the data entered during an erasing operation, it is necessary to clear the input buffer. In this case, too, the erasure-stop key is effectively used to clear the input buffer. Thus, the instant arrangement contributes to improving the typing efficiency.

According to a yet further feature of the invention, the printed characters to be erased consist of a plurality of successive words separated from each other by a space, and the typewriter further comprises: suspending means operable for suspending the erasing operation when a current erasing position of the erasing device is located at the space after at least one of the printed characters has been erased; time-measuring means for measuring a predetermined time during which the erasing operation is suspended; and resuming means responsive to the time-measuring means, for resuming the erasing operation when the predetermined time has elapsed. In this arrangement, the erasing operation is suspended for the predetermained time after each of the plurality of successive words has been erased.

In one form of the above feature of the invention, the typewriter further comprises a display device for displaying a plurality of words which are separated from each other by a space and which are represented by the input data entered through the keyboard, and display-erasing means for erasing the words displayed on the display device. In this case, the suspending means, the time-measuring means and the resuming means are also operable for suspending an erasing operation by the display-erasing means for the predetermined time after each of the words has been erased.

The previously described third object of the invention may be attained according to another aspect of the invention, which provides a typewriter having an automatic intermittent erasing function, comprising: memory means for storing character data representative of characters, and space data representative of spaces between the characters; data-presentation means on which successive words separated from each other by the spaces are presented; continuous-erasure means for continuously erasing the successive words, by means of successively retrieving the character data and the space data from the memory means; suspending means operable for causing the continuous-erasure means to suspend an erasing operation of the successive words when each of the space data has been retrieved from the memory means after at least one of the characters has been erased; time-measuring means for measuring a predetermined time during which the erasing operation is suspended; and resuming means responsive to the time-measuring means, for resuming the erasing operation when the predetermined time has elapsed. Thus, the erasing operation is suspended for the predetermained time after each of the plurality of successive words has been erased.

In the typewriter constructed as described above, the erasing operation is suspended or temporarily stopped for the predetermined length of time after the erasure of each word. This arrangement permits the operator to easily operate a suitable key at a point of time suitable to terminate the erasing operation just when the specific word has been erased, even if the erasing operation is effected at a relatively high speed for reduced erasing time for each word.

The above arrangement wherein the erasing operation is suspended for the predetermined time at the end of erasure of each word is effective even in the case where the erasure of a line of characters is triggered by a single operation of a line-erase key. The intermittent erasure of the words provides a time allowing the operator to operate a suitable cancel or stop key to avoid erasure of the entire line of characters, if the operator notices an error in operating the line-erase key, as soon as the line-erase key has been operated.

The above arrangement is particularly effective when it is applied to erase successive words being displayed on a display device which is one form of the data-presentation means.

According to one feature of the above aspect of the invention, the typewriter further comprises checking means for checking if a current erasing position of the continuous-erasure means is located at one of the spaces, and if so, further checking if a shifting of the current erasing position one position in an erasing direction of the continuous-erasure means is inhibited or not. In this case, the typewriter further comprises means for terminating the erasing operation if the shifting is inhibited.

In one form of the above feature of the invention, the data-presentation means comprises a display device for displaying the successive words and the spaces, and a recording medium on which the successive words are printed, and the checking means determines that the shifting is inhibited if the above-indicated one space is displayed on the display device, at a position corresponding to a predetermined margin position of the recording medium.

According to another feature of the invention, the continuous-erasure means includes an erasure-start key for initiating the erasing operation. In this case, the typewriter further comprises means for checking if the erasure-start key is operated while the continuous-erasure means is located at one of the spaces, and if so, initiating an erasure of one of the words which is preceded by the above-indicated one space, while inhibiting the suspending means and the time-measuring means from operating to provide the predetermined time of suspension after operation of the erasure-start key.

BRIEF DESCRIPTION OF THE DRAWINGS

The above and optional objects, features and advantages of the present invention will become more apparent by reading the following detailed description of a preferred embodiment of the invention, when considered in conjunction with the accompanying drawings, in which:

FIG. 2 is a schematic block diagram showing a control system of the typewriter of FIG. 1;

DETAILED DESCRIPTION OF THE PREFERRED EMBODIMENT

Figure 1:
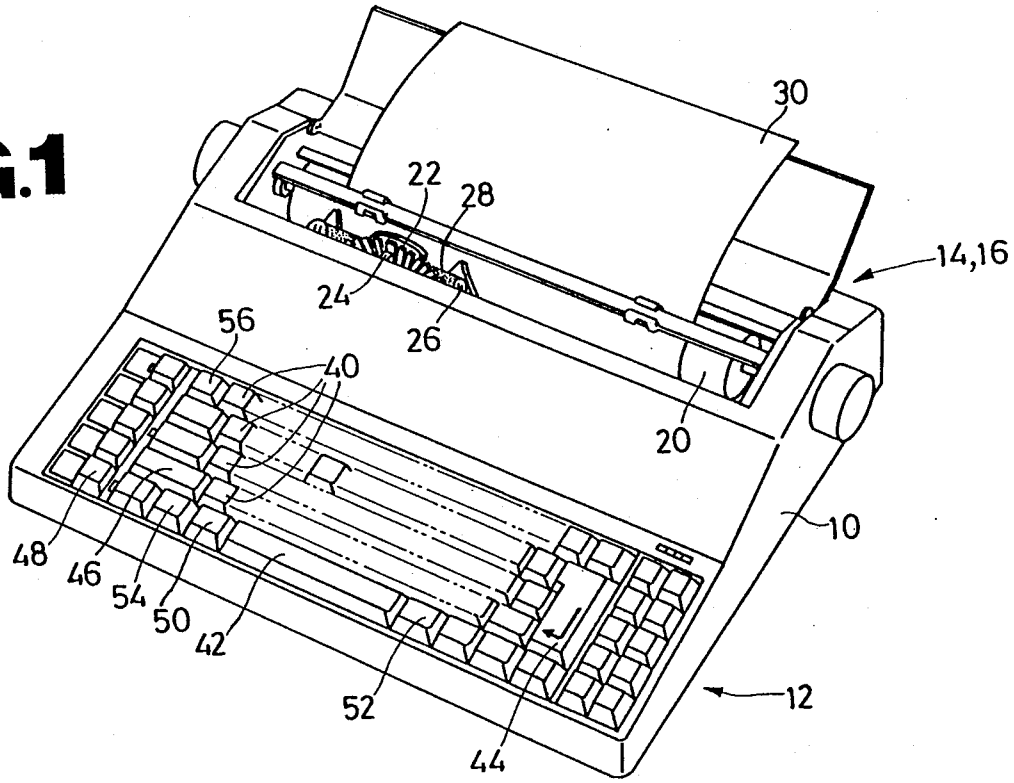
FIG. 1 is a perspective view of one embodiment of a typewriter of the present invention.

Referring to an external perspective view of FIG. 1, there is shown a typewriter embodying the concept of the present invention, which has a keyboard 12 provided at a front part of a casing 10, and a printing mechanism 14 and an erasing mechanism 16 which are provided at a rear part of the casing 10. The keyboard 12 has a multiplicity of keys which will be described.

The printing mechanism 14 includes a platen 20, a type wheel 22, a hammer 24, a print-ribbon vibrator 26, and other elements. The type wheel 22 has a multiplicity of radial arms which have type fonts at their free ends. Selected one of the type fonts is brought into a predetermined printing position aligned with the hammer 24, by means of rotation of the type wheel 22. With the hammer 24 operated, the selected type font is impacted against a sheet of paper 30 on the platen 20, via a print ribbon 28 whose active exposed portion has been lifted to its printing position by the print-ribbon vibrator 26. Thus, a desired character (such as a letter or symbol) corresponding to the impacted type font is printed on the paper 30. The type wheel 22, the hammer 24, the print-ribbon vibrator 26 and the other elements of the printing mechanism 14 are supported on a carriage (not shown), which is adapted to be moved in parallel with an axis of rotation of the platen 20, whereby the printing position is shifted in the direction of width of the paper sheet 30. With the platen 20 rotated, the paper 30 is fed in a direction of its length perpendicular to the axis of the platen, whereby the printing position is shifted in the direction of length of the paper.

The erasing mechanism 16 includes an erase-ribbon vibrator (not shown) that is adapted to lift an active portion of an erase ribbon to its erasing position, in the same manner as the print-ribbon vibrator 26 for lifting the print ribbon 28. This erase-ribbon vibrator cooperates with the platen 20, type wheel 22, hammer 24, and the other elments of the printing mechanism 14, to constitute the erasing mechanism 16.

The keyboard 12 has character keys 40 to enter characters such as alphabetic letters, numerals and symbols, and various function keys such as a space key 42, a CARRIAGE RETURN key 44, a SHIFT key 46, a CODE key 48, a WORD ERASE key 50, an AUTO-CORRECTION KEY 52, a REPEAT key 54, and a MARGIN RELEASE key 56. The functions of these additional function keys will be described later in detail.

Referring next to FIG. 2, there is illustrated a control system of the present typewriter. A major part of the control system is constituted by a microcomputer 72 which incorporates a central processing unit (CPU) 64, a random-access memory (RAM) 66, a read-only memory (ROM) 68, and a bus 70. The microcomputer 72 is connected to the keyboard 12 serving as a data input device.

To the microcomputer 72, there are connected a type-wheel drive motor 100, a hammer drive solenoid 102, a carriage drive motor 104, a platen drive motor 106, a print-ribbon feed motor 108, a print-ribbon lift solenoid 110, and an erase-ribbon lift solenoid 112, via a type-wheel control circuit 80, a hammer control circuit 82, a carriage control circuit 84, a paper feed control circuit 86, a print-ribbon feed control circuit 88, a print-ribbon lift control circuit 90, and an erase-ribbon lift control circuit 92, respectively. The type-wheel drive motor 100 is operated to index the type wheel 22 to position the selected type font to the predetermined printing position aligned with the hammer 24. The hammer drive solenoid 102 is provided to activate the hammer 24. The carriage drive motor 104 is operatively connected to the carriage through a gear train, a timing pulley, a timing belt and other transmission members (not shown), for reciprocating the carriage right and left in the printing direction. The platen drive motor 106 is operatively connected to the platen 20 through a gear train, to rotate the platen 20 in the forward and reverse directions. The print-ribbon feed motor 108 serves as a drive source of a print-ribbon feeding mechanism for feeding the print ribbon 28 by a distance corresponding to the number of characters that have been printed. The print-ribbon lift solenoid 110 serves as a drive source for operating the print-ribbon vibrator 26 indicated above. The erase-ribbon lift solenoid 112 is used to operate the erase-ribbon vibrator for lifting the erase ribbon to the printing point. This lift solenoid 112 also functions as a drive source for feeding the erase ribbon. Described more specifically, each time the erase ribbon is lifted to the printing point by the èrase-ribbon vibrator, the erase-ribbon feeding mechanism (not shown) operatively connected to the erase-ribbon vibrator is activated to increment the erase ribbon by a one-character distance.

The RAM 66 includes a KEY buffer 120 for storing key data which has been entered through the keyboard 12. The key data entered through the keyboard 12 is stored following the already entered data stored in the KEY buffer 120. In response to commands from the CPU 64, the key data stored in the KEY buffer 120 is supplied to the CPU 64 in the order of storage. The RAM 66 further includes a ONE-LINE memory 122 for storing the key data which corresponds to a line of characters that have been already printed on the paper 30. This ONE-LINE memory 122 is cleared each time the CARRIAGE RETURN key 44 is operated. On the other hand, the ROM 68 includes a PROGRAM memory 130 for storing various control programs for controlling the operation of the instant typewriter, such as programs shown in the flow charts of FIGS. 3–5.

Referring to the flow charts of FIGS. 3 through 5, the operation of the typewriter will be described.

Figure 3:
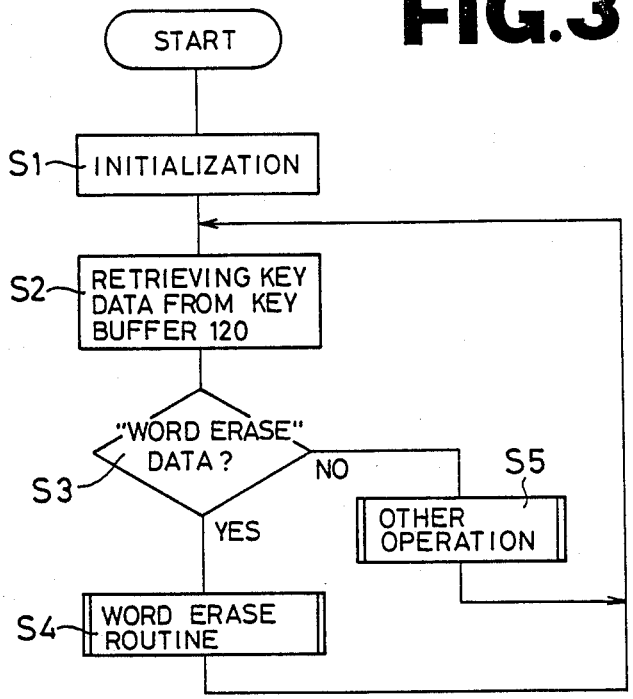
FIGS. 3, 4 and 5 are flow charts illustrating part of control programs stored in a ROM of FIG. 2, which is closely associated with the principle of the present invention.

Upon application of power to the typewriter, the control goes to step S1 of FIG. 3 wherein the typewriter is initialized. Step S1 is followed by step S2 wherein the CPU 64 retrieves the first key data from the KEY buffer 120. Then, the control goes to step S3 to check if the retrieved data is WORD ERASE data corresponding to the WORD ERASE key 50, or not. If the retrieved data is the WORD ERASE data, step S3 is followed by step S4 to perform a WORD ERASE routine. If not, the control goes to step S5 to execute other operation. Steps S4 and S5 are followed by step S2.

During the main routine described above, a KEY-ENTRY processing routine of FIG. 4 is executed as an interval interruption routine. In this interruption routine, the control first goes to step S6 to check if any key on the keyboard 12 has been operated, or not. If not, the routine is terminated. If any key has been operated, the control goes to step S7 to check if a WORD ERASE flag is ON or set at "1". Usually, this flag is OFF or set at "0", and consequently a negative decision is made in step S7. In this case, step S7 is followed by step S8 wherein the key data entered through the keyboard 12 is stored into the KEY buffer 120, and the KEY-ENTRY processing routine is terminated.

Figure 4:
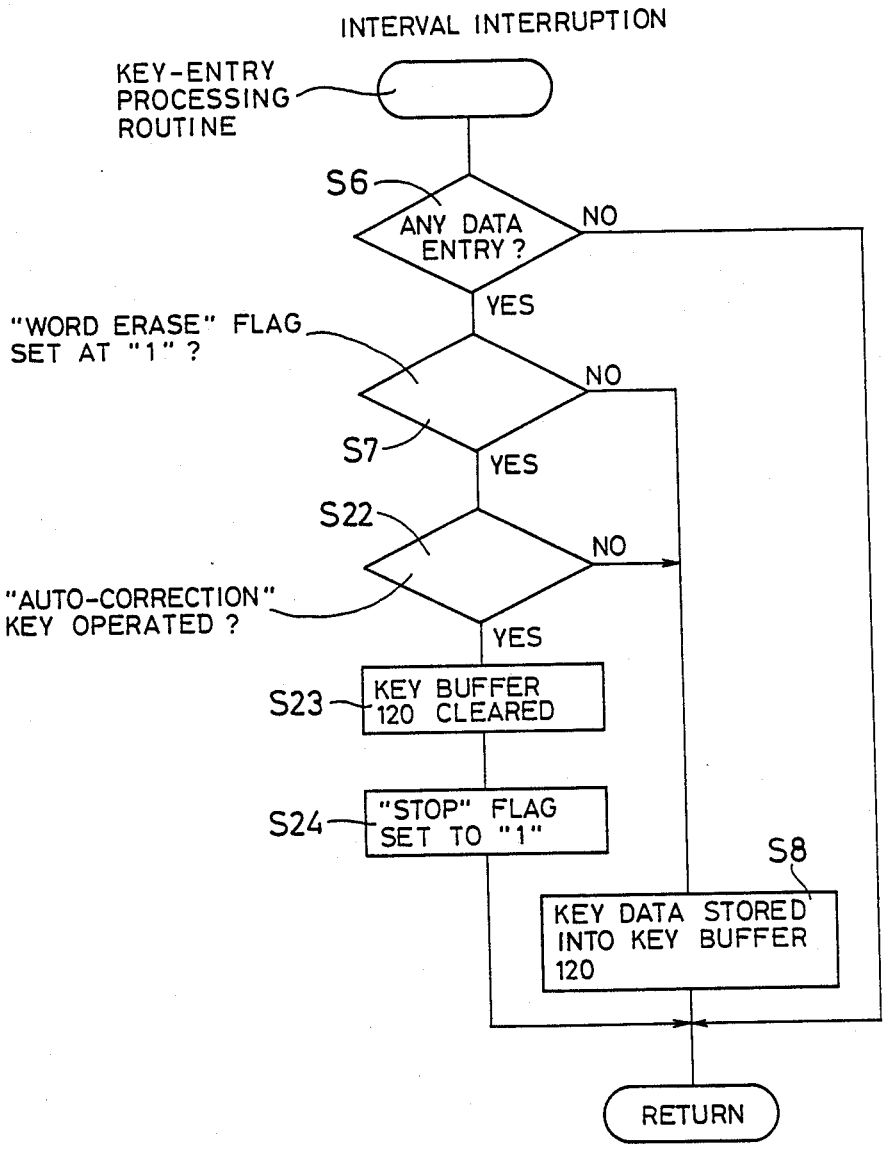

While the key data is stored into the KEY buffer 120 during the interval interruption routine of FIG. 4, step S2 of FIG. 3 is implemented, and an ordinary processing for printing the entered data is executed in step S5. If the WORD ERASE key 50 is operated to erase a word, the WORD ERASE data is stored into the KEY buffer 120. In this case, the stored WORD ERASE data is supplied to the CPU 64 in step S2. As a result, an affirmative decision is obtained in step S3, whereby the WORD ERASE routine of step S4 is implemented.

Figure 5A:
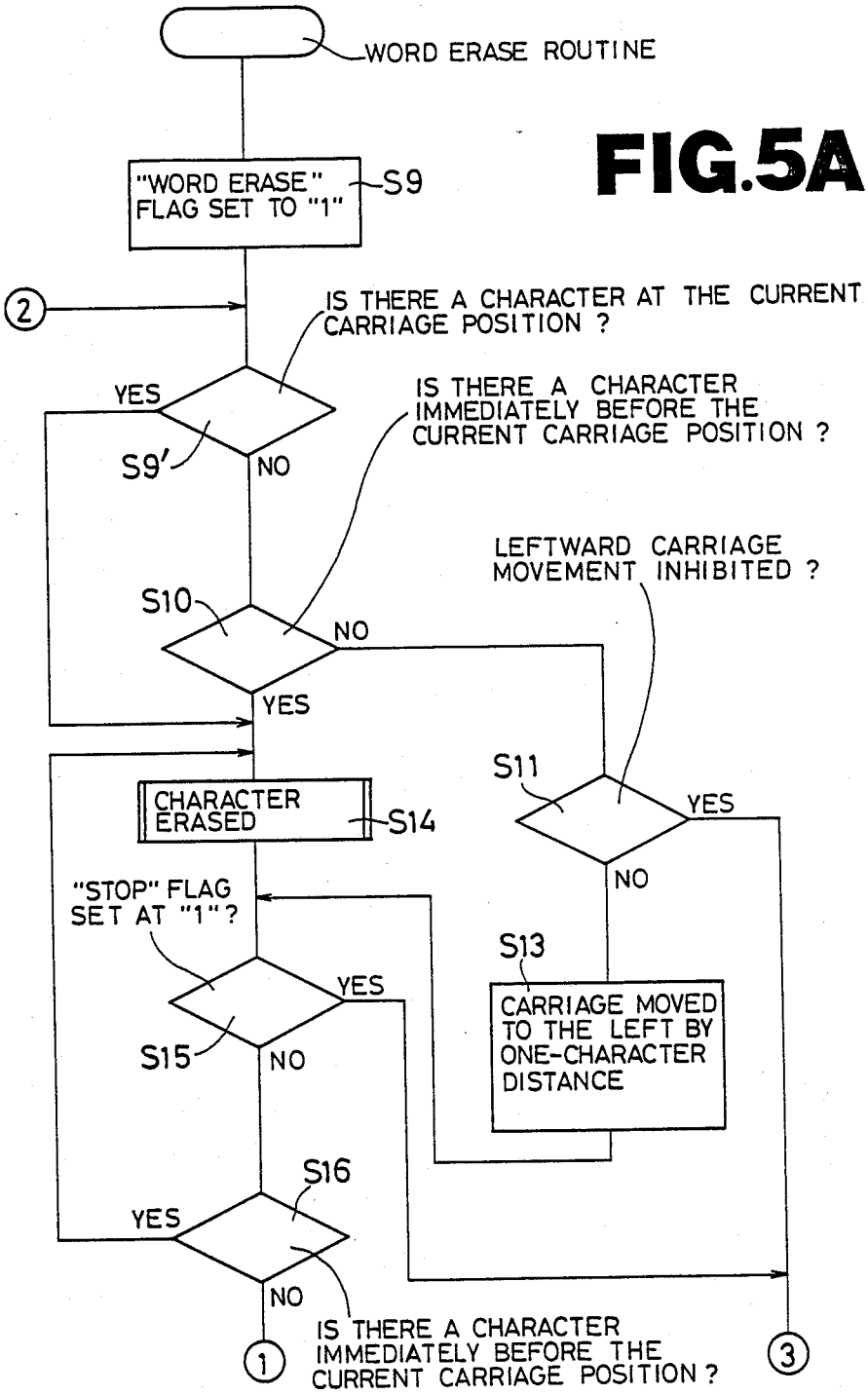
Figure 5B:
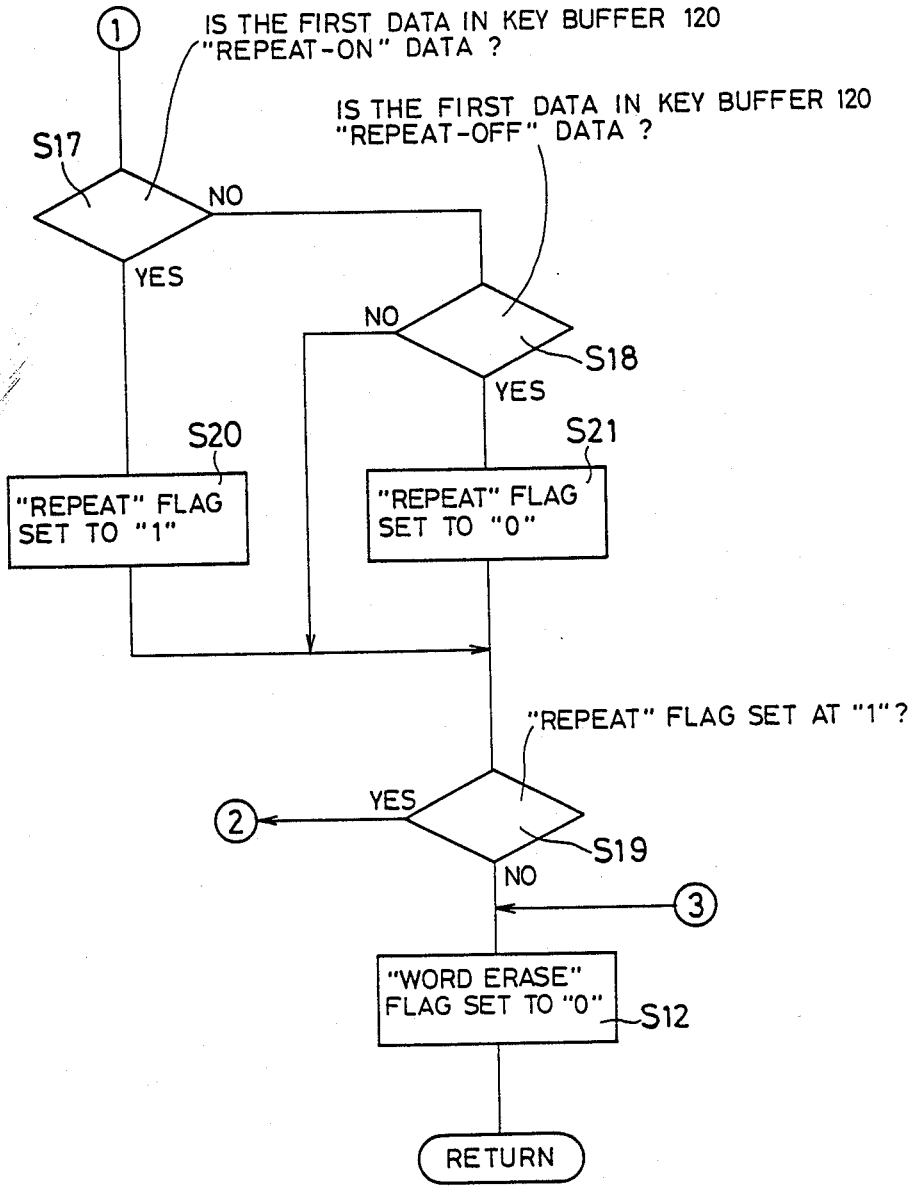
Figure 6:
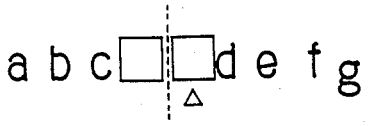
FIGS. 6, 7, 8, and 9 are views for explaining the operation of the typewriter.

The details of this WORD ERASE routine are illustrated in the flow chart of FIGS. 5A and 5B. Initially, the WORD ERASE flag is set to "1" in step S9, and the control goes to step S9' to check if there exists a character at the current position of the carriage. Referring to FIG. 6 wherein a triangular mark indicates the current position of the carriage while a square mark indicates a space, there does not exist a character at the current position of the carriage, in this specific example. Therefore, the CPU 64 makes a negative decision in step S9', and goes to step S10 to check if the carriage (more precisely, the printing position of the carraige) is currently located next to the last printed character in the printing direction, i.e., located immediately following the last printed left character. In a typewriter, the carriage is automatically fed to the right by one-character distance each time a character has been printed. Therefore, if the decision in step S10 is affirmative (YES), it indictes that a printed character exists immediately before the current carriage position (next to the carriage position as viewed in the left direction). If the decision is negative (NO), it means that there exists a space immediately before the current carriage position.

Figure 7:
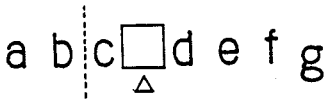
Figure 8:
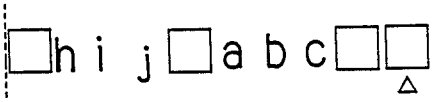
Figure 9:
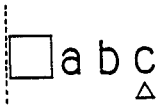
Figure 10:
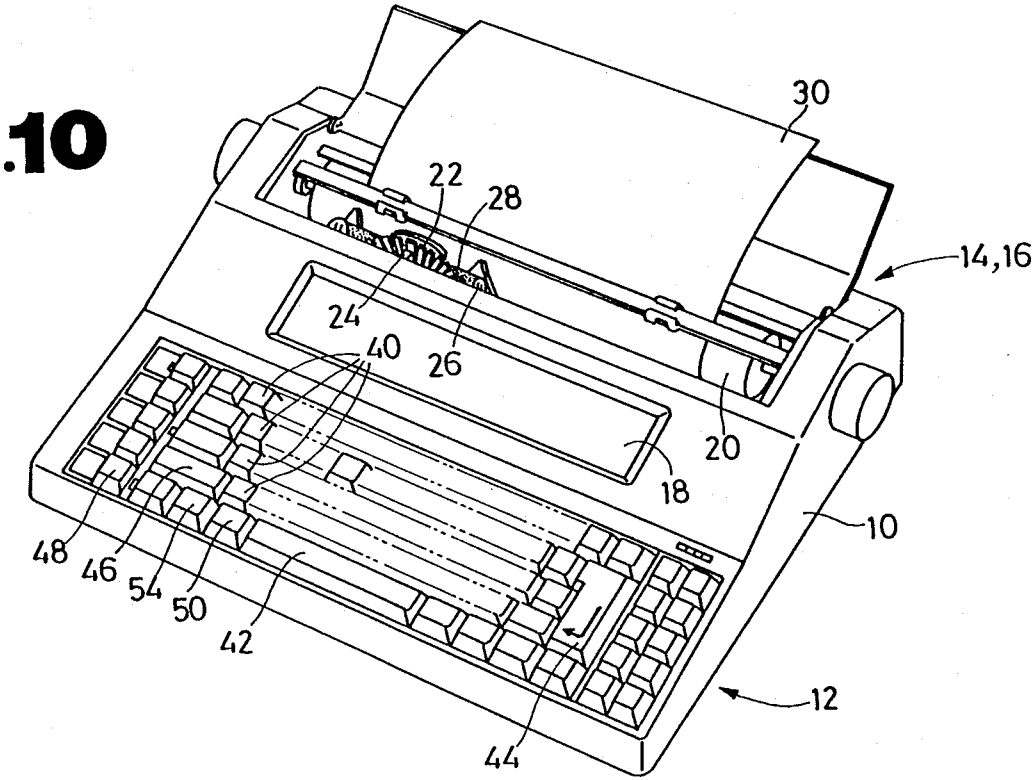
FIGS. 10 and 11 are views corresponding to those of FIGS. 1 and 2, respectively, illustrating another embodiment of the present invention.
Figure 11:
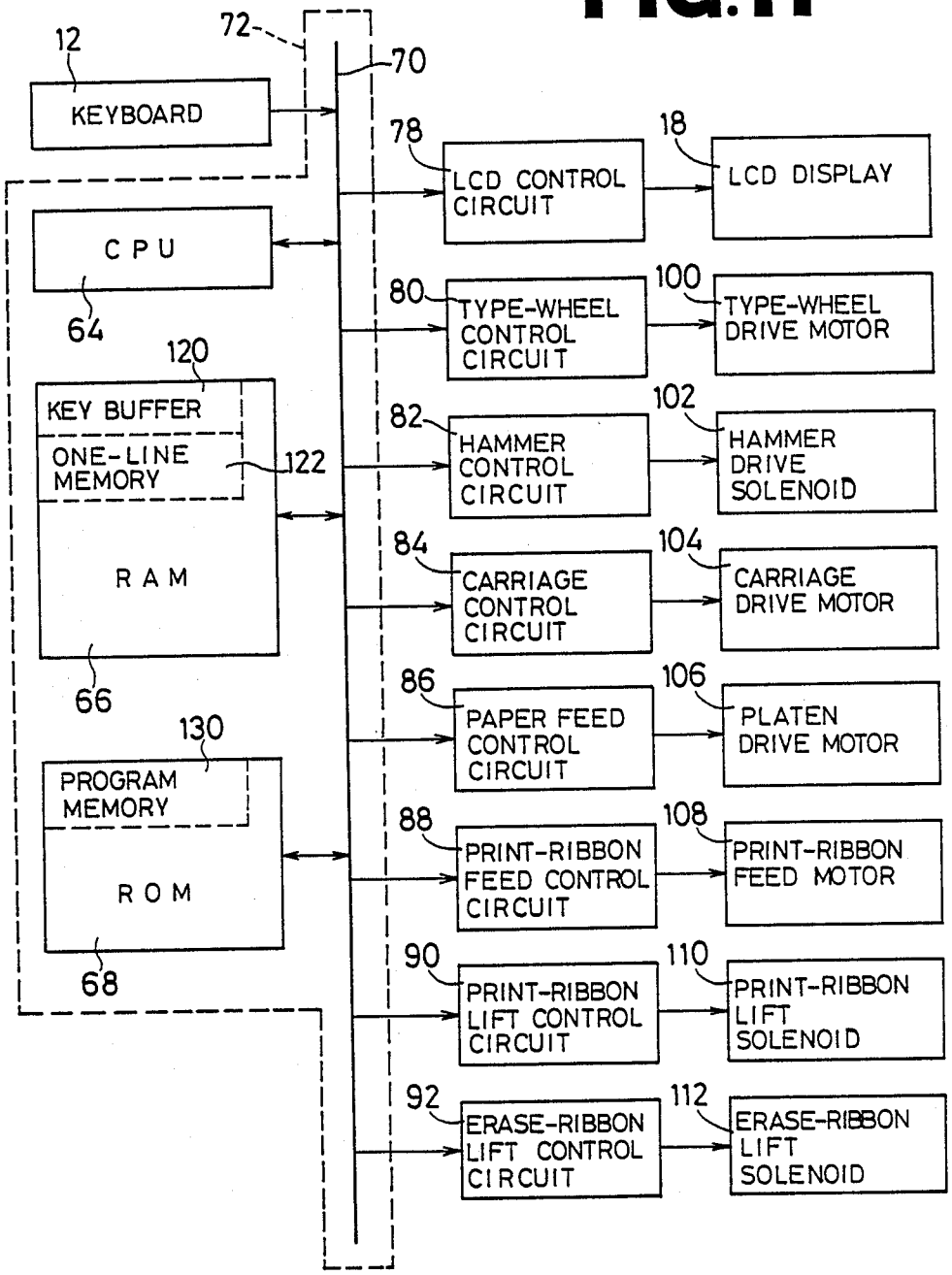

In the case where a space exits immediately before the current carriage position as indicated in FIG. 6, step S10 is followed by step S11 to check if a leftward movement of the carriage is inhibited or not. If the carriage is located at the left margin position as indicated in dashed line in FIG. 6, it is usually better not to erase a word printed to the left of the left margin position, with a space interposed between the word and the margin position, even when the WORD ERASE key 52 is oeprated, unless the MARGIN RELEASE key 56 is operated. On the other hand, if the carriage is located at the position as indicated in FIG. 7, it is usually better to erase a printed word even if the word is located to the left of the left margin position. To distinguish the former case from the latter case, the checking in step 11 is effected. In the case of FIG. 6, an affirmative decision is made in step S11, and the control goes to step S12 to reset the WORD ERASE flag to "0". Thus, the WORD ERASE routine is terminated without actually erasing a word. In the case of FIG. 7, on the other hand, an affirmative decision is made in step S10, and the control goes to step S14 to effect erasure of a character "c" of a word "abc". With steps S14–S16 repeated as described below, all characters of the word "abc" are erased. In the case of FIG. 8, a negative decision is made in step S10, and the control goes to step S11, and then to step S13 to move the carriage to the left by a one-character distance. Thereafter, the control goes to step S16 via step S15. Since the carriage has been moved one position to the left, an affirmative decision is obtained in step S16, and the control goes to step S14, whereby the word "abc" is erased with steps S14–S16 repeatedly executed. If the WORD ERASE key 50 is operated while the carriage is located at a position as shown in FIG. 9, an affirmative decision is obtained in step S9', and the control goes to step S14 to erase a character "c" to erase a word "abc".

The word "abc" is erased in the following manner. As indicated above, the last character "c" of the word "abc" is first erased in step S14. More specifically, the type font corresponding to the character "c" is brought into the printing position by rotation of the type wheel 22 by the type-wheel drive motor 100, according to the data stored in the ONE-LINE memory 122. The erase ribbon is lifted to the erasing position by the erase-ribbon lift solenoid 120, and then the hammer 24 is activated to impact the selected type font against the paper 30, thereby erasing the printed character "c". Usually, however, the above series of operation is executed after the carriage has been moved to the left by a one-character distance. In the specific example of FIG. 9, step S14 is executed immediately following the affirmative decision in step S9'. Consequently, the above series of erasing operation is performed without a previous leftward movement of the carriage.

Subsequently, the control goes to step S15 to check if a STOP flag is set at "1" or not. Usually, a negative decision is made in step S15, and therefore the control goes to to step S16 to check if there is a character immediately before the current carriage position. In this example, the erased character "c" is not preceded by a space, but a character "b", an affirmative decision is made in step S16. Consequently, the control goes back to step S14. With steps S14–S16 repeated, all characters "c", "b" and "a" of the word "abc" are erased. After the last character "a" has been erased, a negative decision is obtained in step S16, whereby the control goes to step S17 to check if the first data in the KEY buffer 120 is REPEAT-ON data. If only the WORD ERASE key 50 has been operated, a negative decision is obtained in step S17, and also in steps S18 and S19 which follow step S17. Therefore, the control finally goes to step S12 to reset the WORD ERASE flag and terminate the WORD ERASE routine.

In the case of FIG. 8, if the REPEAT key 54 is operated while the word "abc" is being erased according to the activation of the WORD ERASE key 50, a word erasing operation is continued even after the erasure of the word "abc", namely, the next word "hij" is also erased. If the REPEAT key 54 is turned off during the erasure of the word "hij", the word erasing operation is terminated after the word "hij" has been erased. This operation will be described in greater detail.

When the REPEAT key 54 is operated during the erasure of the word "abc", the REPEAT-ON data is stored in the KEY buffer 120. Consequently, after the word "abc" has been erased and the decision in step S16 has become negative, an affirmative decision is made in step S17 and a REPEAT flag is set to "1" in step 20. Accordingly, an affirmative decision is obtained in step S19, since the REPEAT flag is now set at "1". Therefore, the control goes back to step S9'. Since the carriage is now located at the position of the erased character "a", a negative decision is made in steps S9' and S10, whereby the control goes to step S11. Since a negative decision is obtained also in step S11, the control goes to steps S13, S15, S16 and S14. Thus, the last character "j" is erased, namely, the erasure of the word "hij" is started.

When the REPEAT key 54 is turned off during the erasure of the word "hij", REPEAT-OFF data is stored into the KEY buffer 120. Therefore, after the first character "h" of the word "hij" has been erased, a negative decision is obtained in step S17 while an affirmative decision is obtained in step S18. Accordingly, the REPEAT flag is set to "0" (off state) in step S21, and as a result, a negative decision is made in step S19. Thus, the control goes to step S12 to reset the WORD ERASE flag to "0", and terminate the WORD ERASE routine.

In the illustrated typewriter wherein a word or successive words may be erased in the manner described above, a repetitive word erasing operation may be stopped by the operator. Further, after the REPEAT key 54 is turned off with a finger pressure removed from the key, it is possible to start keying in desired data through the character keys 40 and other keys, even while a word or words are being erased. If an error is committed during this keying-in operation, the data in the KEY buffer 120 may be erased. These aspects of the invention will be described.

When it becomes necessary to stop a word erasing operation or to erase the data which has been stored in the KEY buffer 120 during the erasing operation, the operator depresses the AUTO-CORRECTION key 52. As a result, the decision in step S22 of FIG. 4 becomes affirmative (YES), and the control goes to step S23 to clear the KEY buffer 120. Then, the control goes to step S24 to set a STOP flag to "1" (on state). Consequently, an affirmative decision is made in step S15 of FIG. 5 which is executed each time a character has been erased. As a result, step S15 is followed by step S12 to reset the WORD ERASE flag to "0" and terminate the WORD ERASE routine. It is noted that if the AUTO-CORRECTION key 52 is operated before the WORD ERASE key 50 is operated, it performs another function, which is not important to understand the principle of the present invention.

If it is necessary to erase all characters of a word whose erasure is interrupted as described above, this complete erasure may be accomplished by operating the WORD ERASE key 50 again. Since a character exists immediately before the current carriage position if the erasure of a word is interrupted, an affirmative decision is obtained in step S10 which is implemented in response to the operation of the WORD ERASE key 50. Hence, steps S14–S16 are repeatedly executed, whereby the remaining characters of the word may be erased.

As is apparent from the foregoing description of the preferred embodiment of the invention, the WORD ERASE key 50 serves as an erasure-start key for initiating erasure of a printed word, while the REPEAT key 54 serves as a word-erasure repeat key for repeating a word erasing operation. However, a single key may function as the erasure-start key and the word-erasure repeat key. For instance, the WORD ERASE key 50 functions as the erasure-start key if it is momentarily depressed, and as the word-erasure repeat key if it is kept depressed. Further, the AUTO-CORRECTION key 52 functions as an erasure-stop key for stopping an erasing operation of a word or words which has been initiated by the erasure-start key. However, another key or a combination of two or more keys may function as the erasure stop key.

In the instant embodiment, a printing device is constituted by the printing mechanism 14, the control circuits 80, 82, 84, 86, 88 and 90, a portion of the ROM 68 storing the programs corresponding to steps S2, S3 and S5 of FIG. 3, and the CPU 64 which executes these programs. Further, an erasing device is constituted by the erasing mechanism 16, the control circuit 80, 82, 84, 92, a portion of the ROM 68 storing the programs corresponding to steps S9, S9', S10, S14–S16 and S12, and the CPU 64 which executes these programs. It is to be understood that the printing mechanism is not limited to a type which uses type fonts, but may be operated with a dot-matrix head or a pen-recording arrangement. Further, the erasing mechanism may be suitably modified to suit the specific printing mechanism. Moreover, the erasing device may be adapted such that if the erasure-start key is operated while the carriage is at the position of an intermediate character of a word, the carriage is automatically moved to the position of the last character of the word before the erasure of that word is started, as described in the previously identified Laid-Open Publication No. 60-210482 of Japanese Patent Application. Of course, the programs for printing and erasing operations may be suitably modified.

In the illustrated embodiment, the ONE-LINE memory 122 and the KEY buffer 120 constitute memory means, and the KEY buffer 120 serves as an input buffer. The portion of the ROM 68 storing the programs corresponding to steps S15, S12, S22 and S24, cooperates with the CPU 64 to constitute erasure-stop control means for interrupting an erasing operation. Further, the portion of the ROM 68 storing the programs corresponding to steps S15, S12, S22 and S23, cooperates with the CPU 64 to constitute buffer-clear control means for clearing the input buffer. Of course, these programs may be suitably modified.

Referring next to FIGS. 10–13, another embodiment of the present invention will be described. In the interest of brevity and simplification, the same reference numerals as used in FIGS. 1 and 2 will be used in FIGS. 10 and 11 to identify the corresponding elements, and these elements will not be described to avoid redundant description.

Unlike the preceding embodiment adapted to erase a printed word or words on the paper 30 by the erasing mechanism 16 upon operation of the WORD ERASE key 50 alone or in combination with the REPEAT key 54, the present modified embodiment as illustrated in FIGS. 10–13 is arranged for erasing a word or words displayed on a display device. This embodiment is different from the preceding embodiment in that a liquid crystal display device 18 (hereinafater referred to a "LCD display") is provided at a central part of the casing 10 of the typewriter. The LCD display 18 has a 20-digit capacity, being capable of displaying up to 20 characters. To control the LCD display 18, a display control circuit 78 is connected to the microcomputer 72. The WORD ERASE key 50 is used to erase a word displayed on the LCD display 18. When the REPEAT key 54 is operated after the WORD ERASE key 50, a plurality of words may be erased.

Upon power application to the typewriter, a main routine consisting of steps similar to the steps S1–S5 of FIG. 3 of the preceding embodiment is executed. While the word erase routine executed in step S4 (illustrated in detail in FIG. 5)of the preceding embodiment relates to the erasure of a printed word or words, the word erase routine executed in the present embodiment relates to the erasure of a displayed word or words on the LCD display 18 (erasure of word data in the ONE-LINE memory 122), as indicated above. For convenience of description, the same step numbers S1–S5 of FIG. 3 are used to indicate the corresponding steps of the main routine to be executed in this second embodiment.

Figure 12:
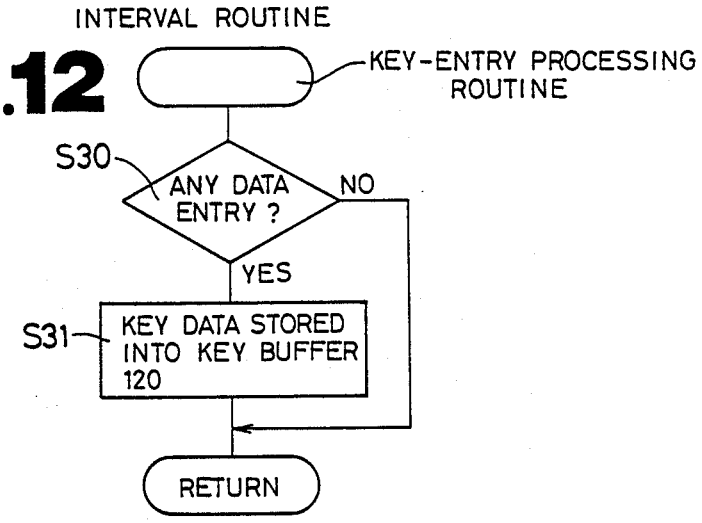
FIGS. 12 and 13 are flow charts showing the operation of the embodiment of FIGS. 10 and 11.

While the main routine is executed, a KEY-ENTRY processing routine is implemented as shown in FIG. 12. Initially, the control goes to step S30 to check if any key on the keyboard 12 has been operated, or not. If not, the KEY-ENTRY processing routine is terminated. If any key has been operated, the control goes to step S31 in which the key data corresponding to the operated key is stored into the KEY buffer 120. After step S31 is over, the routine is terminated.

While key data corresponding to the operated keys are stored into the KEY buffer 120, step S2 of the main routine is executed, and the keyed-in data are printed in step S5 in an ordinary manner. When it becomes necessary to erase a word or words entered through the keyboard 12, the WORD ERASE key 50 is operated. As a result, the WORD ERASE data is stored into the KEY buffer 120 in step S31 of the KEY-ENTRY processing routine of FIG. 12. In the meantime, step S2 is implemented, wherein the CPU 64 retrieves the WORD ERASE data from the KEY buffer 120. This causes an affirmative decision in step S3, resulting in the WORD ERASE routine of step S4 being started.

Figure 13A:
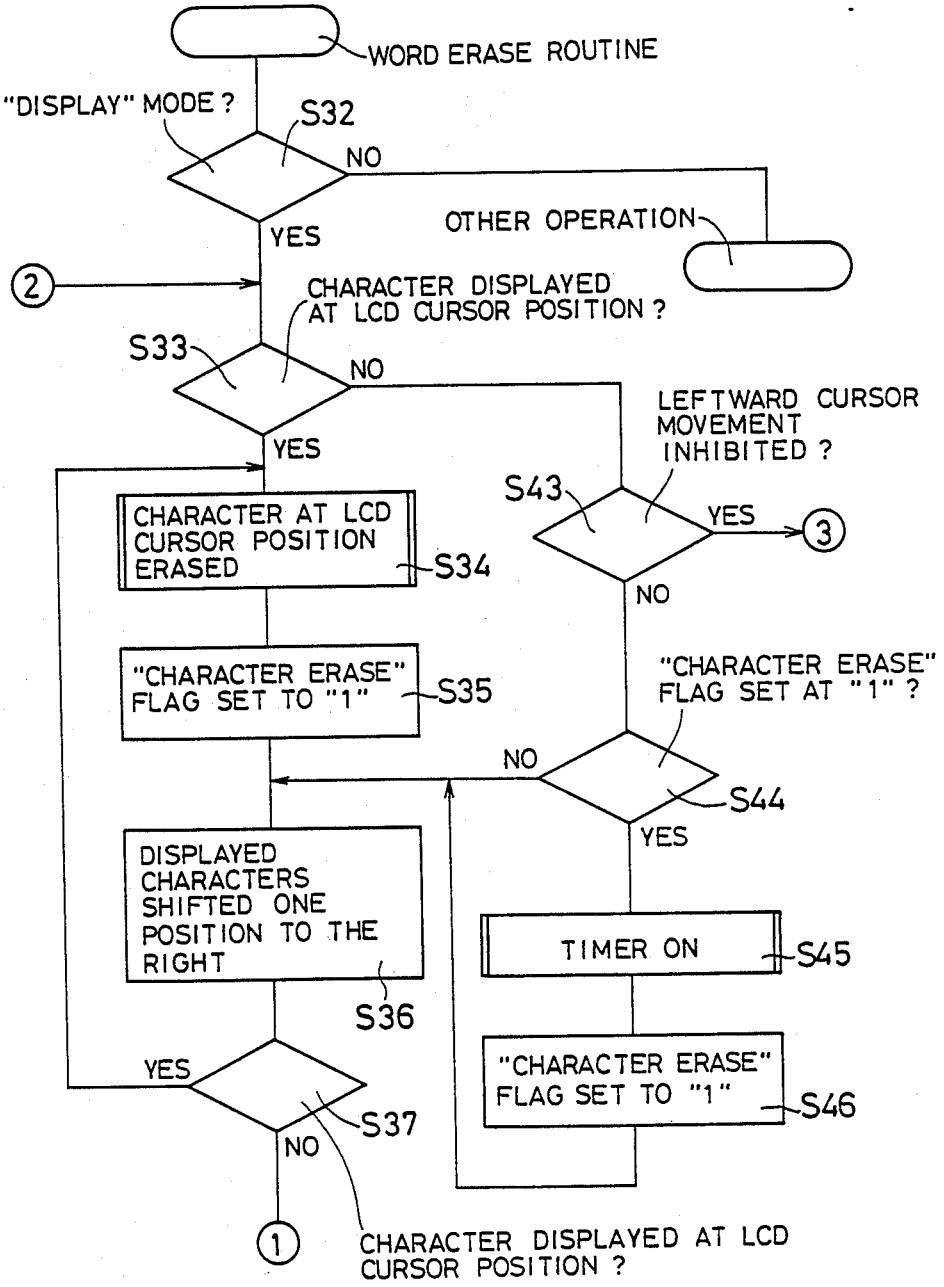
Figure 13B:
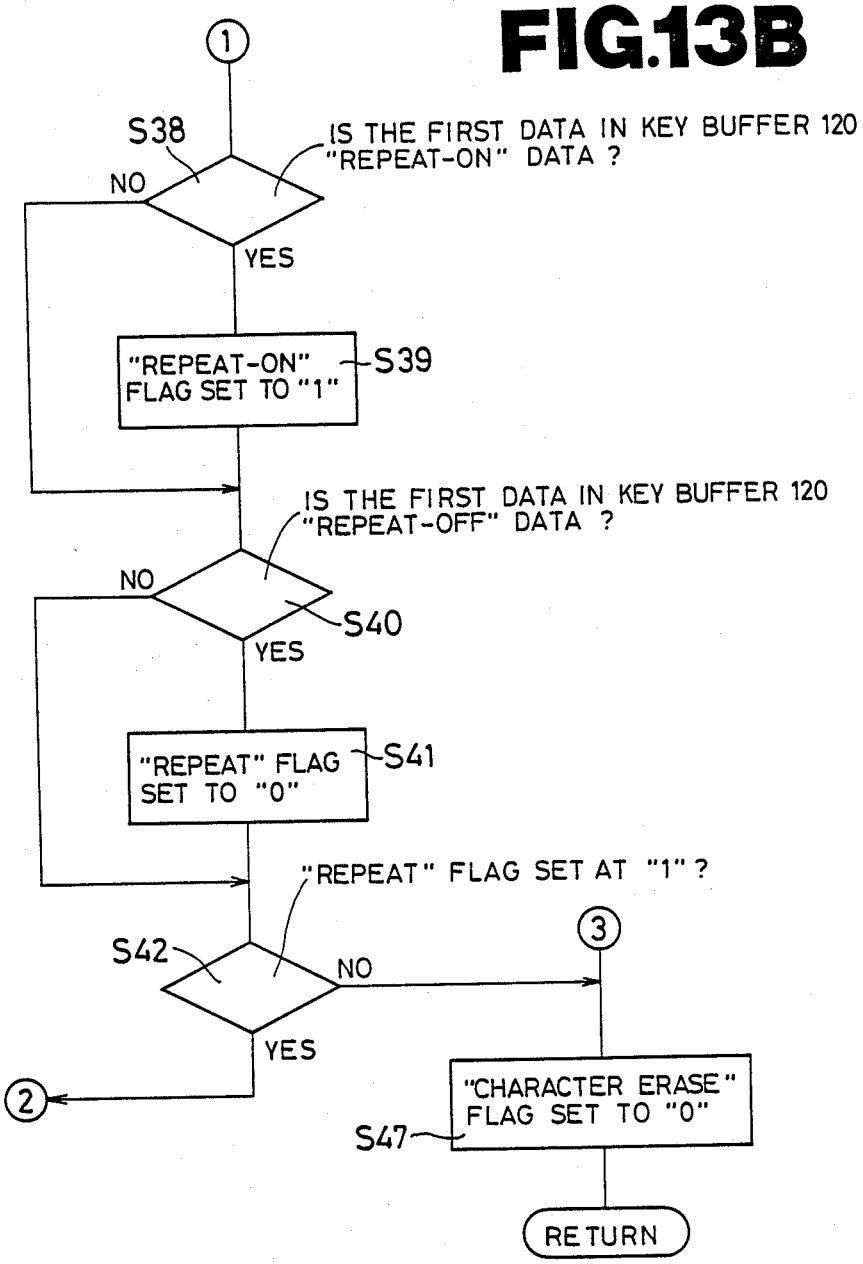

The WORD ERASE routine is illustrated in detail in FIG. 13, wherein the control first goes to step S32 to check if the typewriter is in a DISPLAY mode for displaying characters and spaces on the LCD display 18 according to character data and space data stored in the ONE-LINE memory 122. If not, the CPU 64 executes data processing for other operations such as an erasing operation to erase printed characters on the paper 30 by activating the erasing mechanism 16. If the typewriter is placed in the DISPLAY mode, step S32 is followed by step S33 to check if there exists character data at a memory location of the ONE-LINE memory 122 designated by its memory pointer. In other words, step S33 is provided to check if a character is displayed at the current position of a cursor on the LCD display 18. Usually, the operator moves the cursor of the LCD display 18 to the position of the last character of a word to be erased, before the operator depresses the WORD ERASE key 50. Therefore, an affirmative decision is usually obtained in step S33, whereby the control goes to step S34 to erase the character data at the memory pointer of the ONE-LINE memory 122, and the corresponding character which has been displayed at the cursor position on the LCD display 18.

Then, the control goes to step S35 to set a CHARCTER ERASE flag to "1" (on state), and to step S36 wherein all character and space data in the ONE-LINE memory 122, at higher rank digit positions than the memory pointer position, are shifted one position toward the least significant digit position, whereby the characters displayed to the left of the currently erased character on the LCD display 18 are all shifted one position to the right. Step S36 is followed by step S37 to check if there exists character data at the current memory pointer position of the ONE-LINE memory 122 (if a character is displayed at the current cursor position on the LCD display 18). In the case where the word to be erased consists of a plurality of characters, the decision in step S37 is affirmative (YES), and the control goes back to step S34. Thus, seps S34–S37 are repeated.

With the above steps S34–37 repeatedly executed, all characters of the word of interest are erased from the LCD display 18. After the erasure of the word is over, the cursor of the LCD display 18 (memory pointer of the ONE-LINE memory 22) is located at the position of a space (space data). Consequently, a negative decision is made in step S37, and the control goes to step S38 and the subsequent steps. However, in the case where only the WORD ERASE key 50 has been operated (without operation of the REPEAT key 54), negative decisions are obtained in steps S38, S40 and S42. Accordingly, the control goes to step S47 to reset the "CHARACTER ERASE" flag to "0" (off state) and terminate the WORD ERASE routine. Thus, only one word is erased.

In the case where the WORD ERASE key 50 is operated while the cursor of the LCD display 18 is located at a space, a negative decision is made in step S33, whereby step S33 is followed by step S43 to check if a leftward movement of the cursor is inhibited or not. For instance, when the cursor is located at a position corresponding to the left margin position of the carriage, a leftward movement of the cursor is inhibited. In this case, an affirmative decision is made in step S43, and the control goes to step S47 to terminate the WORD ERASE routine, without any substantial effect produced by the activation of the WORD ERASE key 50. Usually, a negative decision is obtained in step S43, and the control goes to step S44 to check if the CHARACTER ERASE flag is set at "1". In this case, however, the control has never passed step S35 before step S44 is executed, whereby a negative decision is made in step S44. Therefore, step S44 is followed by step S36 wherein the characters displayed on the LCD display 18 to the left of the cursor are shifted one position to the right. This causes the cursor to be located at the last character of a word, resulting in an affirmative decision in step S37. Thus, steps S34–S37 are repeatedly executed, whereby the word is erased from the display 18 (and from the ONE-LINE memory 122).

If the cursor of the display 18 is located at another space even after the displayed characters are shifted one position to the right in step S36, a negative decision is made in step S37, and the control goes to step S47 via steps S38, S40 and S42, whereby the WORD ERASE routine is terminated with the CHARACTER ERASE flag set to "0". Hence, for a word erase operation to be effected, the cursor of the LCD display 18 must be located at the last character of a word to be erased, or at a space following the last character of the word.

When the operator desires to erase a plurality of successive words, the REPEAT key 54 must be operated after the WORD ERASE key 50 is depressed. As long as the REPEAT key 54 is kept depressed, words are erased successively. If the REPEAT key 54 is operated while a first word is being erased, an affirmative decision is obtained in step S38 at the completion of erasure of the first word, and the REPEAT flag is set to "1". While the REPEAT key 54 is held depressed, the last data in the KEY buffer 120 is the REPEAT-ON data, a negative decision is made in step S40, and the control skips step S41 to step S42 to check if the REPEAT flag is set at "1" (on state). Since the REPEAT flag has been set at "1" in step S39, an affirmative decision is obtained in step S42, causing the control to return to step S33.

At the present moment, the cursor of the LCD display 18 (memory point of the ONE-LINE memory 122) is located at a space (space data), and consequently a negative decision is made in step S33, whereby the control goes to execute step S43. Unless the space is located at the left margin position, the decision in step S43 is negative, and step S43 is followed by step S44. Since the CHARACTER ERASE flag has been set to "1" in step S35, an affirmative decision is obtained in step S44, and the control goes to step S45 wherein a timer is activated to measure a predetermined time interval, for example, 0.3 sec. Only after this time interval has lapsed, the control goes to step S46 to set the CHARACTER ERASE flag to "1", and then goes to step S36 wherein the displayed characters to the left of the cursor are all shifted one position to the right. As a result, the cursor is located at the last character of a second word to be erased. Consequently, an affirmative decision is made in step S37, and step S34 is implemented to start erasing the second word.

It will be understood from the above explanation that the time delay of 0.3 sec. is provided in step S45, between the completion of erasure of one word and the commencement of erasure of the next word. Namely, an erasing operation in the REPEAT mode is suspended or interrupted for a time duration of 0.3 sec. at the end of the erasure of each word. In the present embodiment, the portion of the ROM 68 storing the programs corresponding to steps S33, S35, S44, etc. cooperates with the CPU 64 executing these steps, and the CHARACTER ERASE flag, to constitute suspending means for providing an interruption time between the completion of erasure of one word and the commencement of erasure of the next word. The timer which measures the predetermined time interval in step S45 serves as timer means. Further, the portion of the ROM 68 storing the programs corresponding to steps S46, S36 and S37, cooperates with the CPU 64 to constitute erase-resuming means for resuming a suspended or temporarily stopped erasing operation. The portion of the ROM 68 storing the programs corresponding to steps S33, S34, and S36–S42, cooperates with the CPU 64, WORD ERASE key 50 and REPEAT key 54, to constitute continuous-erasure means for continuously erasing data from a memory in the form of the ONE-LINE memory 122, and thereby continuously erasing the corresponding words from the LCD display 18.

In the above illustrated embodiment, the successive words may be erased as long as the REPEAT key 54 is held depressed. However, the last word to be erased may be erased even if the operator releases the REPEAT key 54, provided that the release occurs after the commencement of erasure of the last word. Although the REPEAT-OFF data is stored in the KEY buffer 120 as the last stored data upon releasing the REPEAT key 54, the checking in step S40 is executed only after the erasure of a word is completed by the repetition of previous steps S34–S37. Therefore, if the REPEAT key 50 is released after the erasure of the last word has been commenced, the erasure of the last word may be completed even if the key 50 is released before all characters of the last word have been erased.

Although the above second embodiment is adapted to erase successive words displayed on a display device in the form of the LCD display 18, the principle of the invention as disclosed in the flow chart of FIG. 13 may be practiced for erasing successive words which have been printed on the paper 30. In this case, the erasing mechanism 16 constitute part of the continuous-erasure means for erasing the successive words.

While the principles of the present invention have been described above in detail in its preferred embodiments, it is to be understood that the invention is not limited to the details of the illustrated embodiments, but the invention may be embodied with various changes, modifications and improvements which may occur to those skilled in the art, in the light of the foregoing teachings.

What is claimed is:

1. A typewriter having an automatic erasing function, comprising:

a keyboard having a multiplicity of character keys, and function keys including a separate erasure-start key and a separate erasure-stop key;

memory means for storing input data entered through said keyboard;

a printing device operable for printing on a recording medium characters corresponding to the input data entered through the keyboard;

an erasing device responsive to said erasure-start key, for effecting an erasing operation to successively erase the characters printed by said printing device; and erasure-stop control means responsive to said erasure-stop key, for permitting said erasing device to interrupt said erasing operation.

2. A typewriter according to claim 1, further comprising means for checking if a current erasing position of said erasing device is at a predetermined margin position of said recording medium, and also checking if a space exists between said margin position and a last character of a word to be erased next, the typewriter further comprising means for terminating said erasing operation if said space exits between said margin position and said last character.

3. A typewriter according to claim 1, further comprising means for checking if a current erasing position of said erasing device is located at one of the printed characters, or at a space which is preceded by a last character of a word to be erased next in an erasing direction of said erasing device, said typewriter further comprising means for moving said erasing device one position in said erasing direction before erasing said last character if said current erasing position is at said space, and means for controlling said erasing device to start erasing said one printed character without moving said erasing device if said current erasing position is at said one printed character.

4. A typewriter according to claim 1, further comprising means for checking if a current erasing position of said erasing device is located at one space which is preceded by at least one other space in an erasing direction of said erasing device, which at least one other space is preceded by a last character of a word to be erased next in said erasing direction, the typewriter further comprising means for operating said erasing device to start erasing said word even if said current erasing position of said erasing device is located at said one space.

5. A typewriter according to claim 1, wherein said memory means includes an input buffer memory for storing the input data which is entered through said keyboard while said erasing device is operated, the typewriter further comprising buffer-clear control means for clearing said input buffer upon operation of said erasure-stop key.

6. A typewriter according to claim 1, wherein the printed characters to be erased consist of a plurality of successive words separated from each other by a space, the typewriter further comprising:

suspending means operable for suspending said erasing operation when a current erasing position of said erasing device is located at said space after at least one of the printed characters has been erased;

time-measuring means for measuring a predetermined time during which said erasing operation is suspended; and resuming means responsive to said time-measuring means, for resuming said erasing operation when said predetermined time has elapsed, whereby said erasing operation is suspended for said predetermained time after each of said plurality of successive words has been erased.

7. A typewriter according to claim 6, further comprising a display device for displaying a plurality of words which are separated from each other by a space and are represented by the input data entered through said keyboard, and display-erasing means for erasing the words displayed on said display device, said suspending means, said time-measuring means and said resuming means being also operable for suspending an erasing operation of said display-erasing means for said predetermined time after each of words has been erased.

8. A typewriter having an automatic intermittent erasing fucntion, comprising:

memory means for storing character data representative of characters, and space data representative of spaces between the characters;

data-presentation means on which successive words separated from each other by said spaces are presented;

continuous-erasure means for continuously erasing said successive words, by means of successively retrieving said character data and said space data from said memory means;

suspending means operable for causing said continuous-erasure means to suspend an erasing operation of said successive words when each of said space data has been retrieved from said memory means after at least one of said characters has been erased;

time-measuring means for measuring a predetermined time during which said erasing operation is suspended; and resuming means responsive to said time-measuring means, for resuming said erasing operation when said predetermined time has elapsed, whereby said erasing operation is suspended for said predetermined time after each of said plurality of successive words has been erased thereby allowing an operator to terminate said continuous erasing operation after each of said successive words has been erased.

9. A typewriter according to claim 8, wherein said data-presentation means consists of a display device.

10. A typewriter according to claim 8, further comprising checking means for checking if a current erasing position of said continuous-erasure means is located at one of said spaces, and if so, further checking if a shifting of said current erasing position one position in an erasing direction of the continuous-erasure means is inhibited or not, the typewriter further comprising means for terminating said erasing operation if said shifting is inhibited.

11. A typewriter according to claim 10, wherein said data-presentation means comprises a display device for displaying said successive words and said spaces, and a recording medium on which said successive words are printed, said checking means determining that said shifting is inhibited if said one space is displayed on said display device, at a position corresponding to a predetermined margin position of the recording medium.

12. A typewriter according to claim 8, wherein said continuous-erasure means includes an erasure-start key for initiating said erasing operation, the typewriter further comprising means for checking if said erasure-start key is operated while said continuous-erasure means is located at one of said spaces, and if so, initiating an erasure of one of said words which is preceded by said one space, while inhibiting said suspending means and said time-measuring means from operating to provide said predetermined time of suspension after operation of said erasure-start key.

* * * * *